US011238715B2

(12) United States Patent
Nagel

(10) Patent No.: US 11,238,715 B2
(45) Date of Patent: Feb. 1, 2022

(54) DATA COMMUNICATION OVER ALARM NETWORK TANDEM LINE

(71) Applicant: GENTEX CORPORATION, Zeeland, MI (US)

(72) Inventor: Gregory J. Nagel, Byron Center, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 17/215,523

(22) Filed: Mar. 29, 2021

(65) Prior Publication Data

US 2021/0217285 A1 Jul. 15, 2021

Related U.S. Application Data

(63) Continuation of application No. 16/934,667, filed on Jul. 21, 2020, now Pat. No. 10,984,643.

(60) Provisional application No. 62/876,817, filed on Jul. 22, 2019, provisional application No. 62/940,446, filed on Nov. 26, 2019.

(51) Int. Cl.
*G08B 17/10* (2006.01)
*G08B 1/08* (2006.01)

(52) U.S. Cl.
CPC ..... *G08B 17/10* (2013.01); *G08B 1/08* (2013.01)

(58) Field of Classification Search
CPC ..... G08B 17/10; G08B 1/08; G08B 25/003; G08B 25/04
See application file for complete search history.

(56) References Cited

U.S. PATENT DOCUMENTS

2001/0045895 A1* 11/2001 Ellis ..... G08B 17/10 340/632
2008/0258904 A1* 10/2008 Moss ..... G08B 3/10 340/506
2010/0271220 A1* 10/2010 Pattok ..... G08B 17/103 340/628
2013/0285805 A1* 10/2013 Pattok ..... G08B 25/04 340/506
2016/0071402 A1* 3/2016 Chiarizio ..... G08B 25/009 340/539.17
2019/0334740 A1* 10/2019 Mohiuddin ..... G08B 26/001

* cited by examiner

*Primary Examiner* — Ojiako K Nwugo
(74) *Attorney, Agent, or Firm* — Price Heneveld LLP; Brian James Brewer

(57) ABSTRACT

A device capable of and method for communicating auxiliary data over an alarm network tandem line, whereby noise signals are filtered. The noise signals have an amplitude less than a first threshold. Further, a tandem signal is transmitted or received via a tandem port, wherein the signal transmitted or received is substantially synchronous with a noise signal peak or the transmission does not contain a period greater than the first duration. The period is measured as between two of: one or more disruption point, packet beginning, and packet finish, adjacently disposed. The disruption point is a point where the tandem signal is below a first amplitude threshold. Further, the combined amplitude of the tandem signal and the noise signal is greater than the first threshold.

20 Claims, 14 Drawing Sheets

DATA COMMUNICATION OVER ALARM NETWORK TANDEM LINE

CROSS-REFERENCE TO RELATED APPLICATIONS

This application claims priority under 35 U.S.C. § 120 to U.S. Utility patent application Ser. No. 16/934,667, filed Jul. 21, 2020, entitled "DATA COMMUNICATION OVER ALARM NETWORK TANDEM LINE," which claims priority under 35 U.S.C. § 119(e) to U.S. Provisional Application No. 62/876,817 filed on Jul. 22, 2019, entitled "DATA COMMUNICATION OVER ALARM NETWORK TANDEM LINE," and U.S. Provisional Application No. 62/940,446 filed on Nov. 26, 2019, entitled "DATA COMMUNICATION OVER ALARM NETWORK TANDEM LINE," the disclosures of which are hereby incorporated by reference in their entireties.

FIELD OF INVENTION

The present invention relates in general to smoke or fire alarm tandem line communication, and, more particularly, to communicating auxiliary data beyond mere alarm presence over the tandem line.

BACKGROUND OF INVENTION

Smoke and fire alarm devices of various embodiments have been well known for many years. These alarm devices are often networked together through a tandem line network, such that when one alarm device sounds an alarm, it transmits a signal over the tandem line network, causing the other alarm devices to sound an alarm as well.

Alarm triggering over the tandem line network works by an alarm device simply receiving a signal. However, tandem line networks contain noise signals at approximately 60 Hz. To prevent a false alarm caused by a noise signal, devices are required to: establish a frequency threshold, filter out signals higher than the frequency threshold, and transmit alarm signals at lower frequencies than the frequency threshold. Accordingly, alarm signals transmitted are required to be lower in frequency than the 60 Hz noise.

While these alarm devices are adaptable to accommodate the triggering of multiple alarm types over the tandem line network, the frequency threshold is still required. As an example of multiple alarm type accommodation, a first detector may be configured to individually detect carbon monoxide and smoke, to sound a respective alarm, and to trigger the respective alarm in a second detector via the tandem line network. Differentiation of the alarm types works by assigning different frequencies to each respective alarm. However, alarm signals are still required to be lower in frequency than the threshold frequency.

Presently, communication is limited to basic alarm triggering frequencies greater than the threshold. Accordingly, there is a need for an improved system for communicating over a tandem line.

SUMMARY

According to one aspect of the present invention, an alarm device may include a detector device, a detector controller, and an auxiliary controller. The detector device may be configured to detect an alarm condition. The alarm condition may correspond to any number of conditions. For example, the alarm condition may correspond to the presence of smoke, carbon monoxide, flames, gas particles, or chemicals. The detector controller may be communicatively connected to the detector device. Further, the detector controller may be operable to communicatively connect to a tandem line. Additionally, the detector controller may be further operable to at least one of transmit and receive a first tandem signal, via the tandem line, to or from a second device. The first tandem signal may correspond to an alarm condition. Additionally, the first tandem signal may have a frequency lower than a first threshold frequency. The first threshold frequency may be lower than a noise signal frequency. The noise signal may be present on the tandem line. The auxiliary controller may also be operable to communicatively connect to the tandem line. Further, the auxiliary controller may be operable to at least one of transmit and receive a second tandem signal, via the tandem line. The second tandem signal transmitted or received as one or more packet having periods less than a first duration. The period is measured as between two of: one or more disruption print, packet beginning, and packet finish, the two adjacently disposed. The disruption point may be a point where the tandem signal has an amplitude below a first threshold amplitude. The first threshold amplitude may have an amplitude generally greater than the noise signal amplitude. The first duration may be equal to or less than one period of a second threshold frequency. The second threshold frequency may be lower than the noise signal frequency. In some embodiments, the first threshold frequency may be equal to the second threshold frequency. In additional embodiments, the detector controller and the auxiliary controller may be sub-controllers of a single controller.

The auxiliary device may be communicatively connected to the auxiliary controller. Additionally, the auxiliary device may be operable to at least one of transmit and receive auxiliary data signals respective the auxiliary controller. The second tandem signal may accordingly be based, at least in part, on the auxiliary device data.

The auxiliary controller may be further operable to filter out signals having an amplitude less than the first threshold amplitude. Likewise, the auxiliary controller may be further operable to filter out signals having a frequency lower than the second threshold frequency.

The detector controller may be further operable to receive alarm condition signals from the detector device. Additionally, the detector controller may be further operable to filter out signals having a frequency higher than the first threshold frequency. Further, the detector controller may be operable to at least one of: transmit the first tandem signal upon receipt of an alarm condition signal and trigger an alarm condition feedback upon receipt of the first tandem signal. The alarm condition feedback may be the emission of an audible sound by a speaker.

The device may further comprise an auxiliary port. The auxiliary port may be communicatively connected to the auxiliary controller. Further, the auxiliary port may be configured to receive a wired connection from an auxiliary device. Accordingly, the auxiliary device may be operable to at least one of transmit and receive auxiliary data via a connection facilitated by the auxiliary port.

According to another aspect of the present invention, a device network is disclosed. The device network may include a plurality of alarm devices and one or more auxiliary devices. Both the plurality of alarm devices and the one or more auxiliary devices may be communicatively connected to a network of one or more tandem lines.

Each of the alarm devices may be operable to detect an alarm condition and at least one of transmit and receive a first tandem signal to or from a second alarm device. The first tandem signal may be received or transmitted via the tandem line network. Additionally, the first tandem signal may correspond to an alarm condition and have a frequency lower than a first threshold frequency. The first threshold frequency may be a frequency lower than a noise signal frequency. The noise signal may be present on the tandem line network. The alarm condition may correspond to the presence of at least one of a smoke particle and a gas particle. In some embodiments, each alarm device may be further operable to trigger an alarm condition feedback, upon detection of the alarm condition; transmit the first tandem signal, upon detection of the alarm condition; and/or trigger the alarm condition feedback, upon receipt of the first tandem signal.

Each of the auxiliary devices may be operable to at least one of transmit and receive a second tandem signal over the tandem line network. The tandem signal may be an auxiliary data signal. Further, the auxiliary data signal may be transmitted or received as one or more packets having periods less than a first duration. A period may be measured as between two of: one or more disruption point, packet beginning, and packet finish, the two adjacently disposed. The disruption point may be a point where the tandem signal has an amplitude below a first threshold amplitude. The first threshold amplitude may be generally greater than the noise signal amplitude. The first duration may be equal to one period of a second threshold frequency. The second threshold frequency may be lower than the noise signal frequency. Optionally, the second threshold frequency may be equal to the first threshold frequency. In some embodiments, the auxiliary device may be further operable to filter out signals having a frequency lower than the second threshold frequency. In more embodiments, at least one auxiliary device may be disposed within at least one of the alarm devices. In other embodiments, at least one auxiliary device may be communicatively connected to an alarm device via an auxiliary port of the alarm device.

According to yet another aspect of the present invention, a method for communicating over a network is disclosed. The network may be a fire alarm tandem line network. The method may include filtering out signals having an amplitude below a first threshold amplitude. Additionally, the method may comprise at least one of transmitting and receiving a first signal over a network. The first signal may correspond to an alarm condition and have a frequency lower than a first threshold frequency. The alarm condition may correspond to the presence of at least one of a smoke particle and a gas particle. The first threshold frequency may be a frequency lower than a noise signal frequency. The noise signal may be present on the network. Further, the method may comprise at least one of transmitting and receiving a second signal over the tandem line network. The second signal may be transmitted or received as one or more packets having periods less than a first duration. A period may be measured as between two of: one or more disruption point, packet beginning, and packet finish, the two adjacently disposed. The disruption point may be a point where the tandem signal has an amplitude below a first threshold amplitude. The first threshold amplitude may be generally greater than the noise signal amplitude. The first duration may be equal to one period of the first threshold frequency. In some embodiments, the method may further comprise differentiating between received first signals and received second signals based, at least in part, on frequency. In more embodiments, the method may further comprise triggering an alarm condition feedback, upon receipt of the first signal.

According to yet another aspect of the present invention, an alarm device is disclosed. An alarm device may include a detector device, a tandem line port, and a controller. The detector device may be configured to detect an alarm condition. The alarm condition may comprise the presence of at least one of a smoke particle and a gas particle. The tandem line port may be configured to accept a tandem line network whereby the alarm device can transmit or receive tandem signals over the tandem line, to or from a second device. Accordingly, the tandem line port may facilitate communication between the alarm device and the tandem line network. The controller may comprise an auxiliary controller and may be communicatively connected to the tandem line port. The auxiliary controller may be operable to filter noise signals by setting a threshold amplitude for incoming signals. Further, the auxiliary controller may be operable to transmit a tandem signal, via the tandem port, that is substantially synchronous with a noise signal peak, the combined amplitude of which may be greater than the threshold amplitude. The noise signal peak may have an amplitude generally less than the first threshold. Alternatively, the controller is operable to receive the tandem signal substantially synchronous with the noise signal peak, the combined signal of which is greater than the threshold amplitude and operable to filter the noise below the threshold amplitude.

The alarm device may also comprise one or more auxiliary devices. These auxiliary devices may be operable to communicate auxiliary data with the controller. The controller may in turn transmit or receive the auxiliary data over the tandem line network in the form of the tandem signal. Further, the alarm device may also optionally receive or transmit alarm conditions via the controller in the form of the tandem signal. To accommodate the two different forms of the tandem signal (alarm condition and auxiliary data), the controller may sort signals based on a threshold frequency. The threshold frequency may be greater than a noise signal frequency. Tandem signals having a frequency higher than the frequency threshold may be sorted to the auxiliary controller and signals having a frequency lower than the frequency threshold may be sorted to the detector controller. The detector controller may read these signals as alarm conditions. Further, the detector controller may optionally differentiate between different alarm conditions based on frequency. Furthermore, the alarm device may optionally comprise a speaker, wherein the controller triggers an audible alarm from the speaker, upon receipt of the tandem signal alarm condition.

According to another aspect of the present invention, an alarm device network includes a plurality of detector devices, a network of one or more tandem lines connecting the alarm detectors, and one or more auxiliary devices. The auxiliary devices may be communicatively connected to the tandem line network, each auxiliary device operable to: receive a tandem signal, via the tandem line network; filter noise signals, the noise signals having an amplitude less than a threshold; and transmit or receive an auxiliary data signal over the tandem line network, wherein the auxiliary data signal transmitted or received is substantially synchronous with a noise signal peak, the combined amplitude of the data signal and the noise signal greater than a threshold amplitude.

The alarm devices of the alarm device network may be operable to filter out signals less than a threshold frequency, trigger an alarm upon the detection of a presence of a smoke or a gas particle, and transmit or receive an alarm condition over the tandem line network. The threshold frequency may be lower in frequency than the noise signal frequency. Further, upon receipt of the alarm condition, the alarm device may trigger an alarm condition feedback. Furthermore, auxiliary devices may be integrated into the alarm devices, communicatively integrated into the network via an auxiliary port on an alarm device, or independently communicatively connected to the tandem line network directly.

According to another aspect of the present invention, a method for communicating over a tandem line network includes filtering noise, wherein the noise is below a threshold, and transmitting or receiving a data signal substantially synchronously with a noise signal peak. The combined amplitude of the auxiliary data signal and the noise signal being greater than the threshold.

The method for communicating over the tandem line network may also comprise transmitting an alarm condition signal over the tandem line network by a first alarm detector to a second alarm detector, differentiating between the alarm condition signal and the data signal based on frequency, wherein the alarm condition signal has a frequency lower than a threshold frequency. The threshold frequency lower than a noise frequency. Further, the transmission of the alarm signal by the first alarm detector may be received by a second detector, wherein the second detector may trigger an audible or a visual alarm upon receipt of the alarm condition signal.

According to one aspect of the present invention, a device includes a detector device, a tandem line port, and an auxiliary controller. The detector device may be configured to detect an alarm condition comprising the presence of at least one of a smoke particle and a gas particle. The tandem line port is configured to at least one of receive and transmit a tandem signal, over the tandem line, to or from a second device. The auxiliary controller is communicatively connected to the tandem port. Further, the auxiliary controller may be operable to filter noise signals, the noise signals having an amplitude less than a first threshold, and to at least one of transmit and receive the tandem signal, via the tandem port, as one or more packet, wherein the one or more packets do not contain a period greater than a first duration. The period is measured as between two of: one or more disruption point, packet beginning, and packet finish, adjacently disposed. The disruption point may be a point where the tandem signal is below a first amplitude threshold. Further, the disruption point may be of a sufficient duration, according to a sensitivity of an alarm device. Finally, the duration may be equal to one period of a frequency equal to a first threshold frequency.

The advantages of certain embodiments of the present disclosure include enabling communication of auxiliary data by an alarm device over a tandem line beyond mere alarm presence. Traditionally, alarm devices filtered tandem signals based solely on a threshold frequency, thereby removing interfering signals such as noise. However, such a configuration limits communication to mere alarm condition signals, necessarily substantially lower than the 60 Hz noise frequency. The present disclosure enables the transmission and receipt of auxiliary data by transmitting the data in short high frequency bursts during noise signal peaks or by transmission packets containing disruption points. Further, by maintaining the frequency threshold for alarm conditions, the present disclosure prevents false alarm conditions from being triggered by the auxiliary data tandem signal. Accordingly, the present disclosure overcomes the shortcomings of the prior art.

The advantages of certain embodiments of the present disclosure also include easy creation and modification of auxiliary device networks. For example, auxiliary devices may be easily swapped for one another by unplugging and plugging in new devices, via an auxiliary port, based on new or changing needs. Accordingly, the present configuration allows for additional devices to easily and quickly be retrofit into an existing tandem line network.

These and other aspects, objects, and features of the present invention will be understood and appreciated by those skilled in the art upon studying the following specification, claims, and appended drawings. It will also be understood that features of each embodiment disclosed herein may be used in conjunction with, or as a replacement for, features in other embodiments.

DETAILED DESCRIPTION

Figure 1:
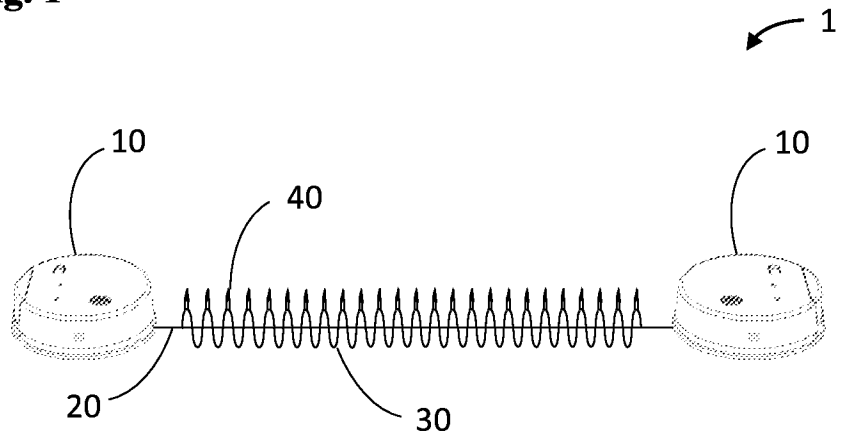
FIG. 1: A schematic representation of an alarm network.

Reference will now be made in detail to present preferred embodiments of the invention, examples of which are illustrated in the accompanying drawings. Whenever possible, the same reference numerals will be used throughout the drawings to refer to the same or like parts.

For the purposes of description herein, the specific devices and processes illustrated in the attached drawings and described in the following specification are simply exemplary embodiments of the inventive concepts defined in the appended claims. Hence, specific dimensions and other physical characteristics relating the embodiments disclosed herein are not to be considered as limiting, unless the claims expressly state otherwise.

FIG. 1 is a schematic representation of an embodiment of an alarm network 1. Alarm network 1 comprises a plurality of alarm devices 10 and a tandem line 20.

Alarm device 10 is a device configured to detect an alarm condition and provide a predetermined feedback. The predetermined feedback is hereafter referred to as an alarm condition feedback. An alarm condition, for example, may comprise the detection of smoke, carbon monoxide, chemical particles, or gas particles. The alarm condition feedback, for example, may be an audible sound, flashing light, or vibration by alarm device 10. In some embodiments, alarm device 10 is operable to transmit or receive an alarm condition over tandem line 20 in the form of a tandem signal. A tandem signal is any signal transmitted over tandem line 20. Further, upon receipt of an alarm condition via tandem line 20 or upon a detection of the alarm condition, alarm device 10 may automatically trigger the alarm condition feedback. The makeup and operation of alarm device 10 is explained in greater detail in FIG. 4 and the related discussion thereof.

Tandem line 20 is a hard wire connection over which signals may be transmitted. Tandem line 20 may take several forms. For example, tandem line 20 may be in the form of a conductive metal wire. Additionally, tandem line 20 may inherently comprise a noise signal 30. Noise signal 30 may have a frequency of approximately 60 Hz and may generally be the product of flowing electrical current and electrical device operation.

In some embodiments, alarm device 10 receives and/or transmits a tandem signal over tandem line 20. The tandem signal may comprise one or more auxiliary data signal 40. Auxiliary data signal 40 is transmitted substantially synchronous with a noise signal 30 peak. If the entirety of the auxiliary data signal 40 to be transmitted is greater in duration than a noise signal 30 peak, auxiliary data signal 40 may be broken up into a series of packets, which are transmitted over subsequent noise signal peaks. The combined amplitude of noise signal 30 and data signal 40 may be greater than an amplitude threshold. The tandem signal may also comprise one or more alarm condition signals. The alarm condition signal has a frequency lower than a frequency threshold.

In other embodiments, alarm device 10 likewise receives and/or transmits a tandem signal over tandem line 20. The tandem signal may comprise one or more auxiliary data signal 40. Further, auxiliary data signal 40 may comprise a series of ones and zeros. Additionally, in this embodiment, auxiliary data signal 40 may be transmitted without being substantially synchronous with a noise signal peak 30, provided the transmission does not contain a period greater than a first duration. The period is measured between two of: disruption points, auxiliary data transmission beginning, auxiliary data packet beginning, auxiliary data transmission finish, and auxiliary data packet finish, the two being adjacently disposed. Further, the first duration is equal to one period of a frequency equal to the frequency threshold. To ensure periods are not greater than the first duration, auxiliary data signal 40 may comprise at least one disruption point. A disruption point may be a zero between noise signal peaks. Accordingly, the combined amplitude of noise signal 30 and auxiliary data signal 40 is less than a threshold amplitude during the transmission of the disruption point. Further, auxiliary data signal 40 may be of any duration.

Further, in some embodiments, alarm device 10 may differentiate between alarm condition signals and auxiliary data signals 40 based on an amplitude and/or frequency threshold. Signals having a frequency lower than the frequency threshold may be the alarm condition signals. Signals having a frequency higher than the frequency threshold and greater than the threshold amplitude may be the auxiliary data signals.

Some embodiments of the present disclosure have the advantage of enabling communication of auxiliary data by alarm device 10, over tandem line 20, beyond, mere alarm presence. Traditionally, alarm devices 10 filter tandem signals based solely on a threshold frequency, thereby removing interfering signals, such as noise 30. However, such a configuration limits communication to mere alarm condition signals, necessarily lower than the 60 Hz noise frequency. Some embodiments of the present disclosure enable the transmission and receipt of auxiliary data by transmitting the data in short high frequency bursts during noise signal peaks. Other embodiments enable the transmission and receipt of auxiliary data by transmitting with periods not greater than a first duration. Further, by maintaining the frequency threshold for alarm conditions, embodiments of the present disclosure prevent false alarm conditions from being triggered by the auxiliary data tandem signal. Accordingly, the present disclosure overcomes the shortcomings of the prior art.

Figure 2:
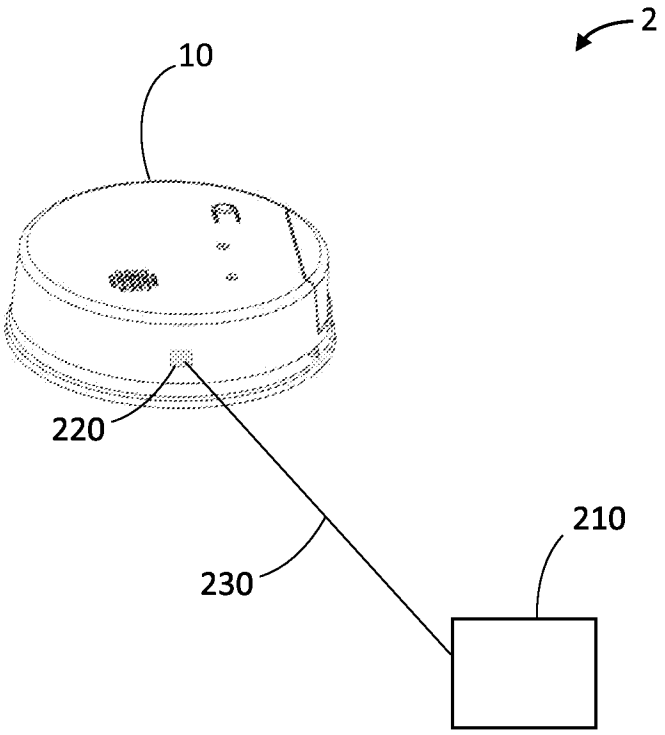
FIG. 2: A schematic representation of an auxiliary network.

FIG. 2 is a schematic representation of an auxiliary network 2. Auxiliary network 2 comprises an alarm device 10, an auxiliary device 210, and an auxiliary connection line 230.

In the illustrated embodiment, alarm device 10 comprises an auxiliary port 220. Auxiliary port 220 is configured to physically receive auxiliary connection line 230 and facilitate the receipt and/or transmission of signals by alarm device 10 over the auxiliary connection line 230.

Auxiliary device 210 may take many embodiments. For example, auxiliary device 210 may be a sensor, such as, a camera, a thermometer, a carbon monoxide detector, a motion detector, a water detector, a humidity sensor; a battery monitor; a microphone; a speaker; a visual display; or a keyboard.

Auxiliary connection line 230 may be a hard wire connection over which signals may be transmitted. Auxiliary connection line 230 may take several forms. For example, auxiliary connection line 230 may be in the form of a conductive metal wire or an optical cable.

In operation, auxiliary device 210 generates an auxiliary data signal. The generated auxiliary data signal is transmitted over auxiliary connection line 230 and received by alarm device 10. Accordingly, alarm device 10 may relay the auxiliary data signal to other alarm devices 10 or auxiliary 210 devices via a tandem line, as a tandem signal. In some embodiments, the auxiliary data signal is transmitted substantially synchronous with a noise signal peak 30, having a combined amplitude greater than an amplitude threshold. In other embodiments, the auxiliary data signal is transmitted such that the transmission does not contain a period greater than a first duration. The period is measured as between two of: one or more disruption point, auxiliary data transmission beginning, auxiliary data packet beginning, auxiliary data transmission finish, and auxiliary data packet finish, the two being adjacently disposed. The combined amplitude of the noise signal and the data signal is less than an amplitude threshold during the transmission of a disruption point. Accordingly, a disruption point may be a zero between noise signal peaks. Further, the first duration is equal to one period of a frequency equal to the threshold frequency.

Some embodiments have the technical advantage of enabling auxiliary devices 210 to communicate signals via a pre-existing tandem line 20 network in place for use by alarm devices 10. Further, the present auxiliary network 2 has the advantage of being easily created and modified. For example, auxiliary devices 210 may be easily swapped for one another by unplugging and plugging in new devices to the auxiliary port 220 based on new or changing needs.

Accordingly, the present configuration allows for additional devices to easily and quickly be retrofit into an existing tandem line network.

Figure 3A:
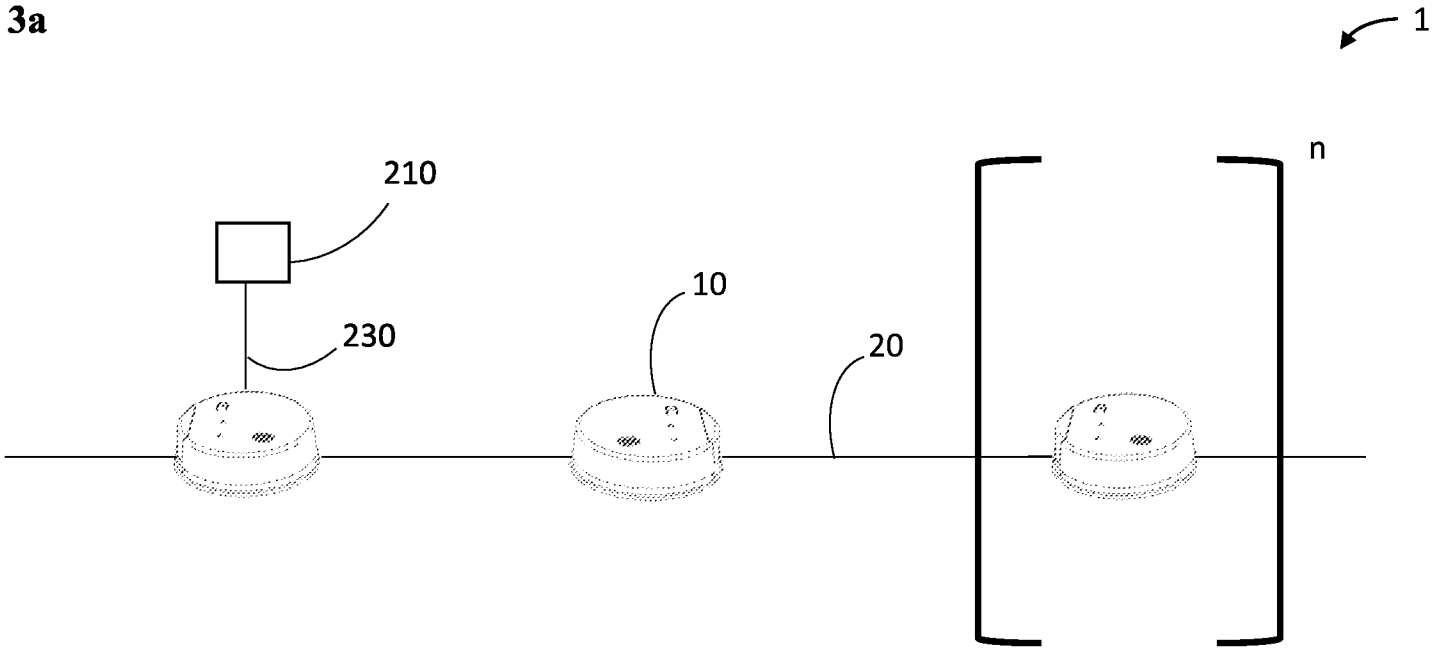
FIG. 3*a*: A schematic representation of a series alarm network.
Figure 3B:
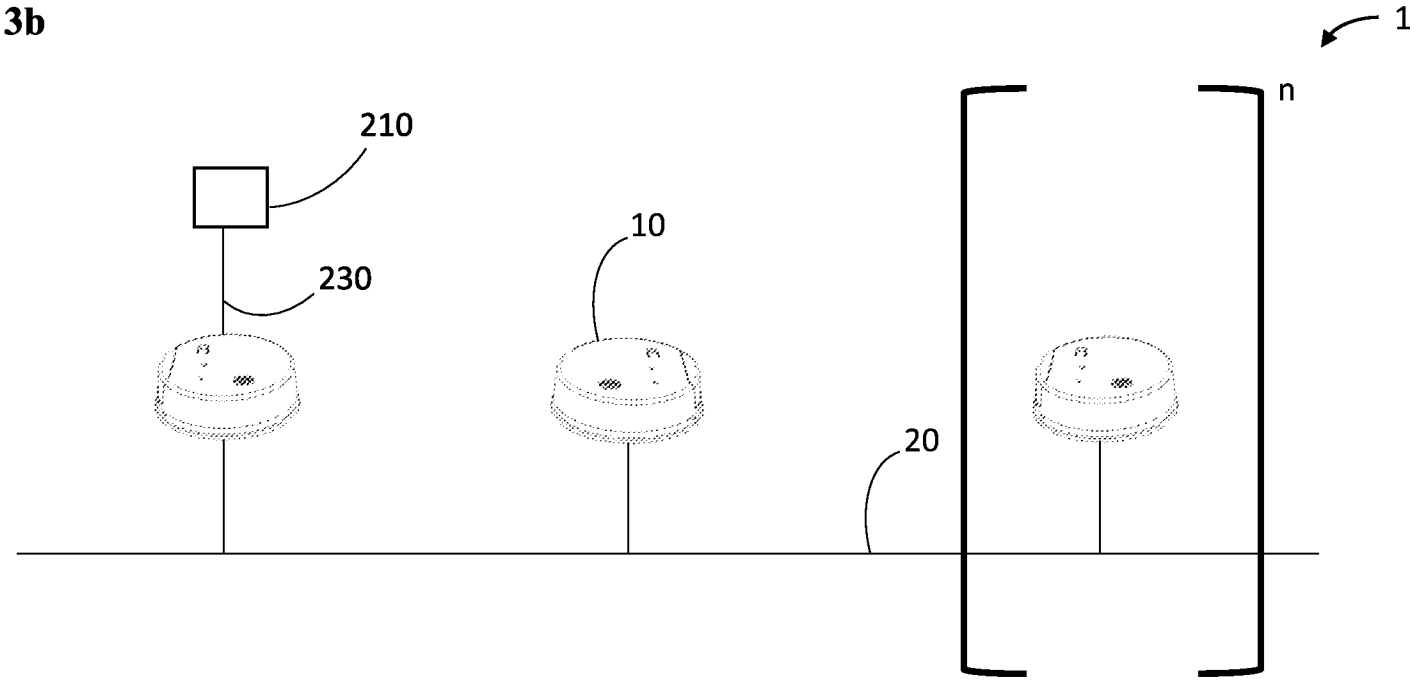
FIG. 3*b*: A schematic representation of a parallel alarm network.
Figure 3C:
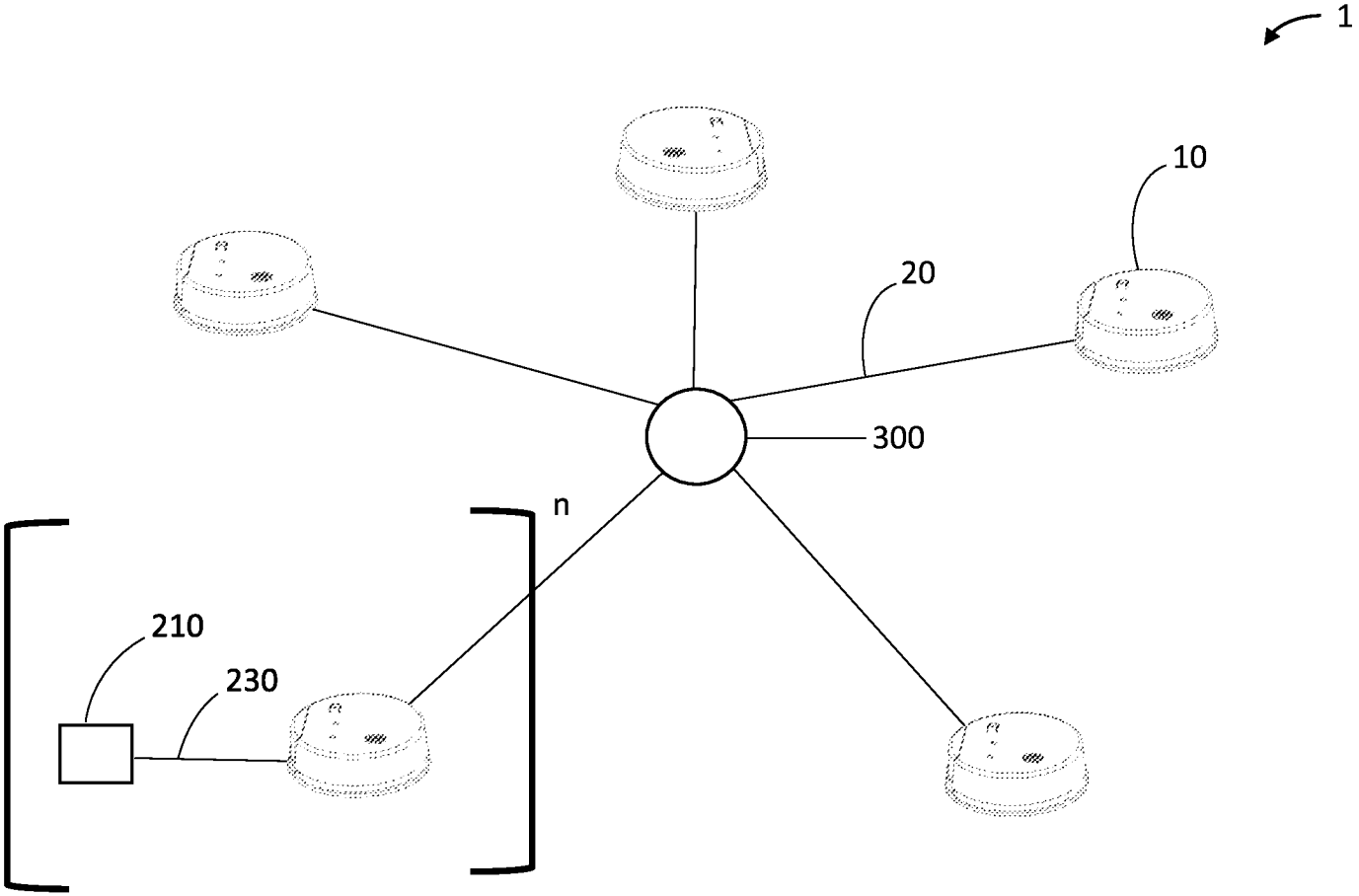
FIG. 3*c*: A schematic representation of a wheel and spoke alarm network with a communication hub.

FIGS. 3*a-c* illustrate schematic representations of an alarm network 1. Alarm network 1 comprises a plurality of alarm devices 10 and a network of tandem lines 20.

An alarm device 10 is a device configured to detect an alarm condition and subsequently provide an alarm condition feedback. An alarm condition, for example, may comprise the presence of smoke, carbon monoxide, chemical particles, or gas particles. The alarm condition feedback, for example, may be the triggering of an audible sound, flashing light, or vibration by the alarm device. The alarm condition detection may automatically trigger alarm condition feedback.

A tandem line 20 is a hard wire connection over which signals may be transmitted. The tandem line 20 may take several forms. For example, the tandem line 20 be in the form of a conductive metal wire.

As illustrated in FIG. 3*a*, alarm devices 10 may be linked in series, where tandem signals are sequentially relayed from one alarm device 10 to another, over a series of tandem lines 20. Alternatively, as illustrated in FIG. 3*b*, alarm devices 10 may be linked in parallel, where tandem signals are transmitted over a tandem line 20 to one or more alarm device 10 substantially simultaneously. In another alternative configuration, as illustrated in FIG. 3*c*, alarm devices 10 may be linked in a wheel and spoke pattern.

In the wheel and spoke configuration of FIG. 3*c*, alarm network 1 further comprises a communication hub 300. Communication hub 300 may be a device through which signals from the tandem line network 20 may be communicated. For example, the signals may be relayed from one alarm device 10, or group of alarm devices 10, to another; transformed into data displayed on a user interface linked to communication hub 300; or transformed into data and wirelessly transmitted to a user's personal communications device, such as a cell phone, where it may be displayed. Additionally, communication hub 300 may be configured to receive wireless signals such that remote commands may be received from devices, outside the present network, such as from a personal communications device. Further, the user interface may be operable to re-set a single alarm device; re-set a group of alarm devices; and/or display detailed information related to auxiliary data, such as temperatures and concentrations.

Additionally, in any alarm network 1 configuration, alarm device 10 may further comprise an auxiliary network comprising an auxiliary device 210 and an auxiliary connection line 230. Auxiliary device 210 may take many embodiments. For example, auxiliary device 210 may be a sensor, such as, a camera, a thermometer, a carbon monoxide detector, a motion detector, a water detector, a humidity sensor; a battery monitor; a microphone; a speaker; a visual display; and/or a keyboard.

Auxiliary connection line 230 may be a hard wire connection over which signals may be transmitted. Auxiliary connection line 230 may take several forms. For example, auxiliary connection line 20 may be in the form of a conductive metal wire or an optical cable.

While FIGS. 3*a-c* illustrate alarm networks 1 having a limited number of devices, alarm network 1 may include any plurality of alarm devices 10, in any number of arrangements, such as any combination of the above illustrations.

In some operations of the present embodiments, alarm device 10 may transmit and/or receive a tandem signal over tandem line 20. The tandem signal may comprise one or more alarm condition signal. The alarm condition signal having a frequency lower than a threshold frequency. Upon receipt of the alarm condition signal, via the tandem line 20, alarm device 10 may trigger an alarm condition feedback.

Also, the tandem signal may comprise one or more auxiliary data signal. In some embodiments, the auxiliary data signal is transmitted substantially synchronous with a noise signal peak. The combined amplitude of the noise signal and the auxiliary data signal being greater than an amplitude threshold. In other embodiments, the auxiliary data signal is transmitted such that the transmission does not contain a period greater than a first duration. The period measured between two of: disruption points, auxiliary data transmission beginning, auxiliary data packet beginning, auxiliary data transmission finish, and auxiliary data packet finish, the two being adjacently disposed. The combined amplitude of the noise signal and the auxiliary data signal is less than an amplitude threshold during the transmission of a disruption point. Accordingly, a disruption point may be a zero between noise signal peaks. Further, the first duration is equal to one period of a frequency equal to the threshold frequency.

Additionally, in some embodiments, alarm device 10 may differentiate between alarm condition signals and auxiliary data signals based on thresholds. Signals having a frequency lower than a frequency threshold may be alarm condition signals. Signals having a frequency less than the frequency threshold and greater than the threshold amplitude may be auxiliary data signals.

Moreover, in some embodiments, communication hub 300 may relay signals from one alarm device 10 or group of alarm devices 10 to another; may transform tandem signals into data related to auxiliary detectors, such as temperatures and concentrations, for display on a user interface; may transform tandem signals into data and wirelessly transmit to a user's personal communications device for display; or may receive wireless remote commands from devices, outside the present network, such as from a personal communications device or an in car display.

Accordingly, some embodiments have the advantage of allowing data beyond mere alarm condition to be communicated between alarm devices 10. Traditionally, alarm devices 10 filter tandem signals based solely on a threshold frequency, thereby removing interfering signals such as noise 30. However, such a configuration limits communication to mere alarm condition signals, which are necessarily lower than the 60 Hz noise frequency. In some embodiments, the present disclosure enables the transmission and receipt of auxiliary data by transmitting the data in higher frequencies during the noise signal peaks. Other embodiments enable the transmission and receipt of auxiliary data by transmitting with periods not greater than a first duration. Further, by maintaining the frequency threshold for alarm conditions, the present disclosure prevents false alarm conditions from being triggered by the auxiliary data tandem signal.

Additionally, the present disclosure enables the use of communication hub 300 to convey auxiliary detector data to a user. Previously, a communication hub 300 would be limited to conveying information such as alarm conditions, identifying a spoke the alarm condition came from, and data detected by the communication hub 300 itself. However, now auxiliary data related to various cites of auxiliary detectors may likewise be conveyed. Accordingly, the present disclosure overcomes the shortcomings of the prior art.

Figure 4:
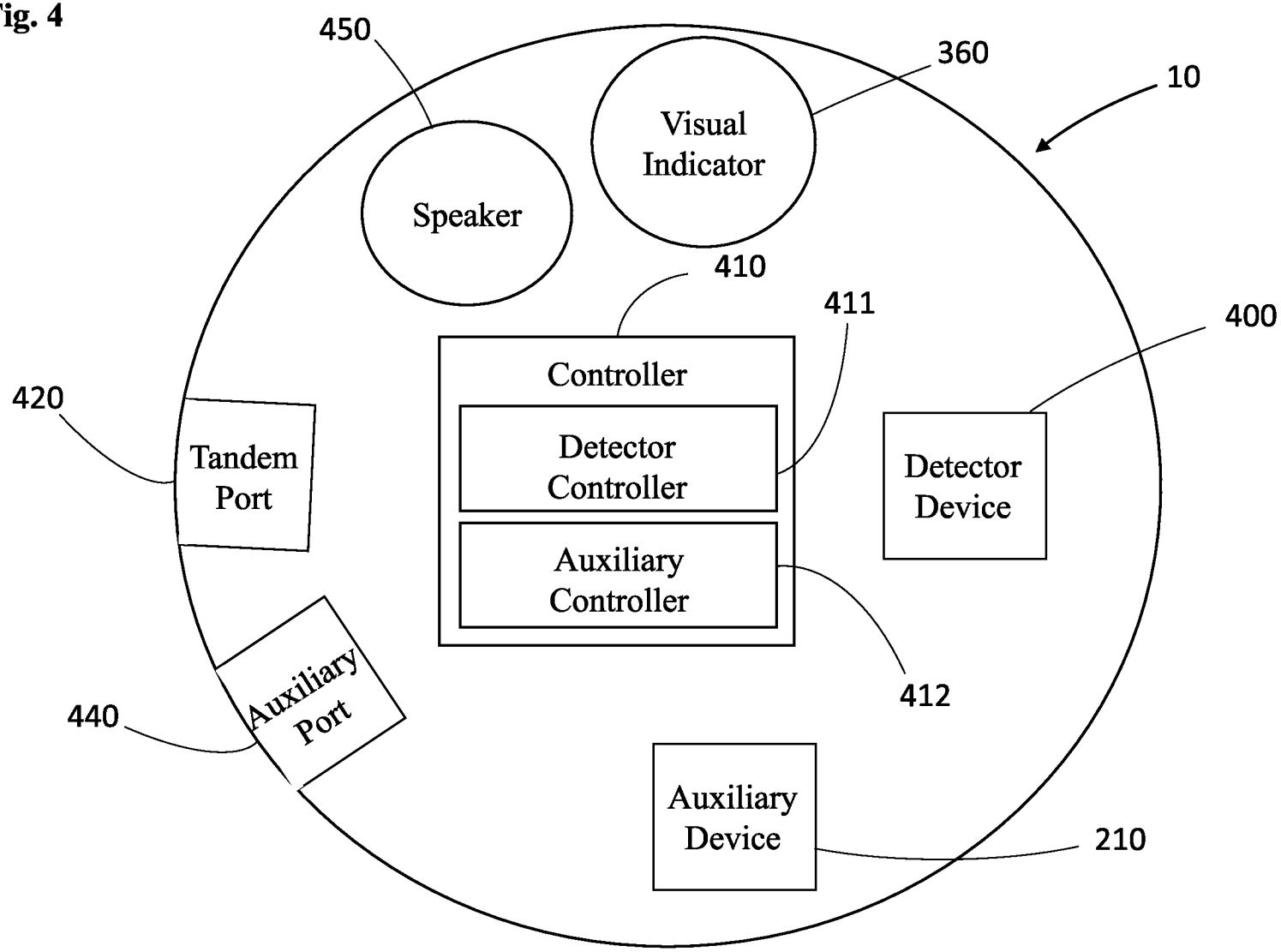
FIG. 4: A schematic representation of an alarm device.

FIG. 4 illustrates a schematic representation of an alarm device 10. Alarm device 10 comprises a controller 410 and a tandem port 420. In some embodiments, alarm device 10 may also comprise one or more of a detector device 400, an auxiliary device 210, an auxiliary port 440, a speaker 450, and a visual indicator 260.

Detector device 400 is a device configured to detect an alarm condition. An alarm condition, for example, may comprise the detection of smoke, carbon monoxide, chemical particles, or gas particles.

Controller 410 is a device configured to receive, process, and/or transmit signals, and in some embodiments, to optionally control the operation of one or more components of detector device 400. Further, controller 410 is communicatively connected to tandem port 420. Additionally, controller 410 may comprise a detector controller 411 and/or an auxiliary controller 412. While controller 410 is represented as having detector and auxiliary sub-controllers 411, 412, controller 410 may take several forms. The detector and auxiliary sub-controllers 411, 412 may have physically separate identities. Further, auxiliary controller 412 may be placed within an auxiliary device 210 as the auxiliary device's 210 own separate controller. However, controller 410 may also be a single physical item, with the detector and auxiliary sub-controllers 411, 412 merely separate electronic pathways.

Tandem port 420 is a receptacle configured to physically receive a tandem line. The receipt of the tandem line is such that the alarm device 10 is communicatively connected to the tandem line enabling the receipt and/or transmission of tandem signals thereon.

Auxiliary device 210 is any device configured to capture and transmit and/or receive and utilize data. Auxiliary device 210 may take many embodiments. For example, auxiliary device 210 may be a sensor, such as a camera, a thermometer, a carbon monoxide detector, a motion detector; a battery monitor; a microphone; a speaker; a visual display; or a keyboard. Further, auxiliary device 210 may be placed within alarm device 10, or external alarm device 10 and communicatively connected to alarm device 10 via an auxiliary connection line, as shown in FIG. 2.

Auxiliary port 440 is a receptacle configured to physically receive an auxiliary connection line. The auxiliary connection line is a hard wire connection over which signals may be transmitted. The auxiliary connection line may take several forms. For example, the auxiliary connection line 20 may be in the form of a conductive metal wire or an optical cable.

Speaker 450 is a device configured to emit an audible alarm. Speaker 450 is operably coupled to controller 410 or detector controller 411 and may be substantially enclosed in a housing of alarm device 10.

Visual indicator 360 is a device configured to emit a light in the visible spectrum. Visual indicator 360 may come in may forms, for example, as an LED, CFL, incandescent, or halogen light bulb. Visual indicator 360 may be operably connected to controller 410 and positioned such that the light may escape the housing of alarm device 10 and emit into the surrounding environment.

In operation, tandem and auxiliary ports 420, 440 operate to facilitate a communicative connection between the device to which each are coupled and a tandem or auxiliary line, respectively.

Controller 410 receives and/or transmits a tandem signal via tandem port 420. Tandem port 420 is communicatively connected to a tandem line and relays the tandem signal present on the tandem line. The tandem line inherently comprises a noise signal. The noise signal may be approximately 60 Hz. Further, controller 410 routs signals to and from the detector and auxiliary controllers 411, 412. When routing to the detector and auxiliary controllers 411, 412, controller 410 may rout the tandem signal as unprocessed in its raw form or it may sort tandem signals according to an auxiliary threshold frequency and an alarm condition threshold frequency. The auxiliary and alarm condition threshold frequencies may be frequencies lower than the noise frequency. Signals above the auxiliary threshold frequency may be routed to auxiliary controller 412. Signals below the alarm threshold frequency may be routed to detector controller 411. Additionally, controller 410 may optionally receive and/or transmit an auxiliary line signal via auxiliary port 440.

Auxiliary controller 412, when receiving signals originating from tandem port 420, may isolate a tandem signal from the tandem line by filtering out noise and other signals. Signals may be filtered based on a threshold amplitude, the threshold being generally greater than the noise signal amplitude. Further, the tandem signal is processed into auxiliary device data for use by an auxiliary device 210. In some embodiments, auxiliary controller 412 may filter tandem signals above an auxiliary threshold frequency, if not done so by controller 410. The auxiliary threshold frequency is a frequency lower than the noise frequency. Accordingly, any alarm condition signals on the tandem line may be filtered out by auxiliary controller 412. Further, when implemented, filtering out tandem signals above the auxiliary threshold frequency occurs before filtering based on the threshold amplitude.

When transmitting signals via tandem port 420, auxiliary controller 412 may process auxiliary device data into a tandem signal. The tandem signal may comprise a series of packets. In some embodiments, the tandem signal is transmitted over the tandem line substantially synchronous with a noise signal peak. If the entirety of the tandem signal cannot be transmitted in the duration of one noise signal peak, the tandem signal may be broken up into a series of packets, which are transmitted over subsequent noise signal peaks. In other embodiments, the auxiliary data signal is transmitted such that the duration of the transmission does not contain a period greater than a first duration. The period measured between two of: disruption points, auxiliary data transmission beginning, auxiliary data packet beginning, auxiliary data transmission finish, and auxiliary data packet finish, the two being adjacently disposed. The combined amplitude of the noise signal and the data signal is less than an amplitude threshold during the transmission of a disruption point. Accordingly, a disruption point may be a zero between noise signal peaks. Further, the first duration is equal to one period of a frequency equal to the frequency threshold.

When transmitting signals via auxiliary port 440, auxiliary controller 412 may send signals in any form. For example, the signals may be in a basic signal form, may be substantially synchronous with a noise peak, or may be such that no auxiliary signal transmission has a period greater than the first duration. Likewise, when receiving signals via auxiliary port 440, auxiliary controller 412 may receive signals in any form.

Detector controller 411, processes the tandem signal. A tandem signal lower than an alarm condition threshold is recognized as an alarm condition signal. The alarm condition threshold frequency is lower than the signal noise frequency. An alarm condition signal may trigger an alarm condition feedback. In some embodiments, based on the tandem signal's frequency, detector controller 411 may determine different alarm conditions. For example, the controller may assign a frequency of approximately 5 Hz as a carbon monoxide alarm condition and a frequency of approximately 1 Hz as a smoke alarm condition. Further, when receiving signals not already isolated by controller 410, detector controller 411 may isolate a tandem signal from the tandem line by filtering out noise and other signals, before processing the tandem signal. Signals are filtered based on an alarm condition threshold frequency.

Further, detector controller 411, upon the determination of the alarm condition, may trigger an alarm condition feedback. For example, detector controller 411 may trigger speaker 450 to emit an audible alarm and/or visual indicator 360 to emit a flashing light. Additionally, the alarm condition feedback triggered may be determined by the specific alarm condition. For example, a smoke alarm condition may cause speaker 450 to emit an audible alarm of one sound and/or visual indicator 360 to emit a light of one color, and the carbon monoxide alarm condition may cause speaker 450 to emit an audible alarm of a different sound and/or visual indicator 360 to emit a light of a different color.

Additionally, detector controller 411, may transmit a tandem signal over the tandem line, via tandem port 420. When detector controller 411 receives an alarm condition from a detector device 400 or determines an alarm condition from a tandem signal, it may determine a corresponding tandem signal frequency and transmit the frequency over the tandem line.

Auxiliary device 210 in operation may gather, collect, or otherwise generate auxiliary data. Subsequently, auxiliary device 210 may transmit the generated auxiliary data, via auxiliary controller 412, as a tandem signal over the tandem line. Additionally, auxiliary device 210 may likewise receive auxiliary data from the tandem line, via auxiliary controller 412.

Finally, while the auxiliary threshold frequency and alarm condition threshold frequency may be different, it is preferable that they are equal and operate as a single frequency threshold, sorting signals as auxiliary data signals being higher than the threshold or alarm condition signals being lower than the threshold.

The present disclosure has the advantage of enabling communication of auxiliary data by alarm device 10 over a tandem line beyond mere alarm presence. Alarm devices 10 traditionally filter to a tandem signal based on an alarm condition threshold frequency, thereby removing noise. However, such a configuration limits the information communicated to mere alarm condition types based on low frequencies, which are necessarily lower than the 60 Hz noise frequency. The present disclosure enables the transmission and receipt of auxiliary data by transmitting the data in high frequency bursts during the noise signal peaks or in packets not having a period longer than a first duration. Further, by maintaining the frequency threshold for alarm conditions, false alarm conditions may be prevented from being triggered by the auxiliary data tandem signal.

Figure 5:
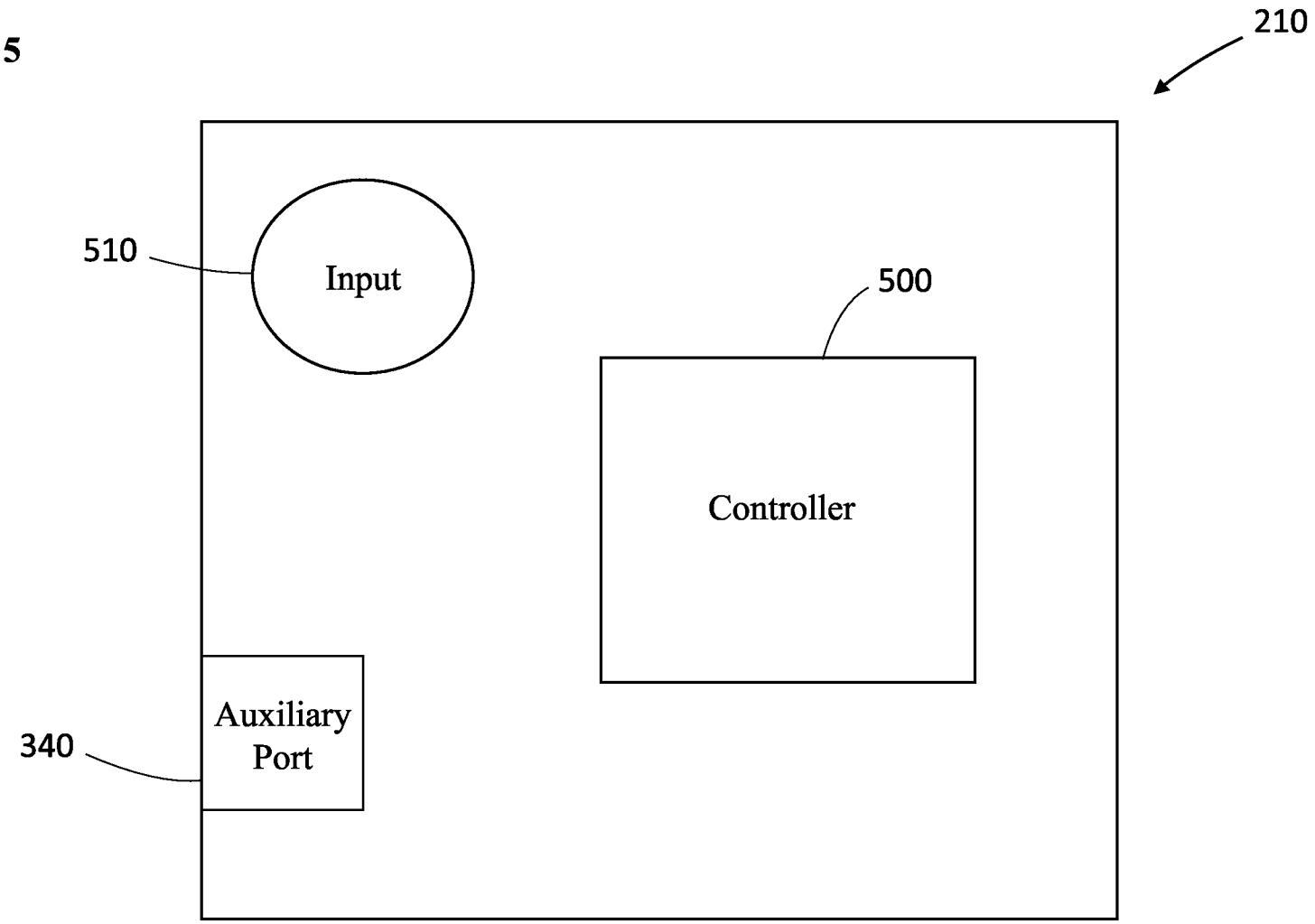
FIG. 5: A schematic representation of an auxiliary device.

FIG. 5 illustrates a schematic representation of auxiliary device 210. Auxiliary device 210 comprises an input 510. In some embodiments, auxiliary device 210 also comprises a controller 500, and/or an auxiliary port 440. Further, auxiliary device 210 may be disposed within an alarm device or separately as a unit external the alarm device.

Input 510 may take any number of forms and may be any source for inputting, receiving, or generating data. For example, input 510 may be a concentration detector, such as for carbon monoxide, smoke, gas, or chemicals; a motion detector; an imager, such as a camera in the IR or visible spectra; a battery level sensor; a thermometer; a water sensor; a humidity sensor; or a keyboard.

Controller 500 is a device configured to control the operation of one or more components of auxiliary device 210 and/or to receive, process, and/or transmit signals. Further, controller 500 is communicatively connected to an auxiliary port 440. Further, controller 500 may be or comprise an auxiliary controller.

Auxiliary port 440 is a receptacle configured to physically receive an auxiliary line. The auxiliary line is a hard wire connection over which signals may be transmitted. The auxiliary line may take several forms. For example, the auxiliary line may be in the form of a conductive metal wire or an optical cable. Further, auxiliary port 440 is configured to facilitate a communicative connection between the auxiliary device 210 and an auxiliary line.

In operation, controller 500 may transmit and/or receive a signal on an auxiliary line, via auxiliary port 440. Auxiliary port 440 may be communicatively connected to the auxiliary line and controller 500. A received signal may be auxiliary data that has previously been processed from a tandem signal by an auxiliary controller in an alarm device communicatively connected to the auxiliary line. However, controller 500 may also comprise an auxiliary controller in the event that the signal received is a signal unprocessed and passively relayed to auxiliary device 210 or the signal transmitted by auxiliary device 210 is transmitted directly to a tandem line.

The auxiliary controller, when receiving signals, isolates a tandem signal from the tandem line by filtering out noise and other signals. Signals may be filtered based on a threshold amplitude, the threshold amplitude being generally greater than the noise signal amplitude. The tandem signal may be processed into auxiliary device data for use by auxiliary device 210.

When transmitting signals, the auxiliary controller may send raw data or processes auxiliary device data into a tandem signal. In some embodiments, the tandem signal is transmitted over the tandem line substantially synchronous with a noise signal peak. If the entirety of the tandem signal cannot be transmitted in the duration of one noise signal peak, the tandem signal may be broken up into a series of packets, which are transmitted over subsequent noise signal peaks. In other embodiments, the auxiliary data signal is transmitted such that the duration of the transmission does not contain a period greater than a first duration. The period measured between two of: disruption points, auxiliary data transmission beginning, auxiliary data packet beginning, auxiliary data transmission finish, and auxiliary data packet finish, the two bing adjacently disposed. The combined amplitude of the noise signal and the data signal is less than an amplitude threshold during the transmission of a disruption point. Accordingly, a disruption point may be a zero between noise signal peaks. Further, the first duration is equal to one period of a frequency equal to the frequency threshold.

In some embodiments, when the signal has not previously been filtered based on an auxiliary threshold frequency, the auxiliary controller filters tandem signals above an auxiliary threshold frequency. The auxiliary threshold frequency is a frequency lower than the noise frequency. The noise frequency may generally be 60 Hz. Accordingly, any alarm condition signals on the tandem line may be filtered by the auxiliary controller. Further, when implemented, the filtering of tandem signals above the auxiliary threshold frequency occurs before the filtering based on the threshold amplitude.

Embodiments of the present disclosure may have the advantage of enabling auxiliary data communication by an auxiliary device 210 over a tandem line. Traditionally, tandem lines are limited to mere alarm condition signals and filter noise based on frequency. However, such a configuration limits the information communicated to mere alarm condition types based on low frequencies which are necessarily lower than the 60 Hz noise frequency. The present disclosure enables the transmission and receipt of auxiliary data by transmitting the data in higher frequency bursts during the noise signal peaks, or by ensuring the transmission does not contain a period greater than the first duration. Further, by maintaining the frequency threshold for alarm conditions, the present disclosure prevents false alarm conditions from being triggered by the auxiliary data tandem signal. Accordingly, the present disclosure enables the communication of data from auxiliary devices over an alarm network tandem line without interfering with the tandem lines alarm condition communication operation.

Figure 6:
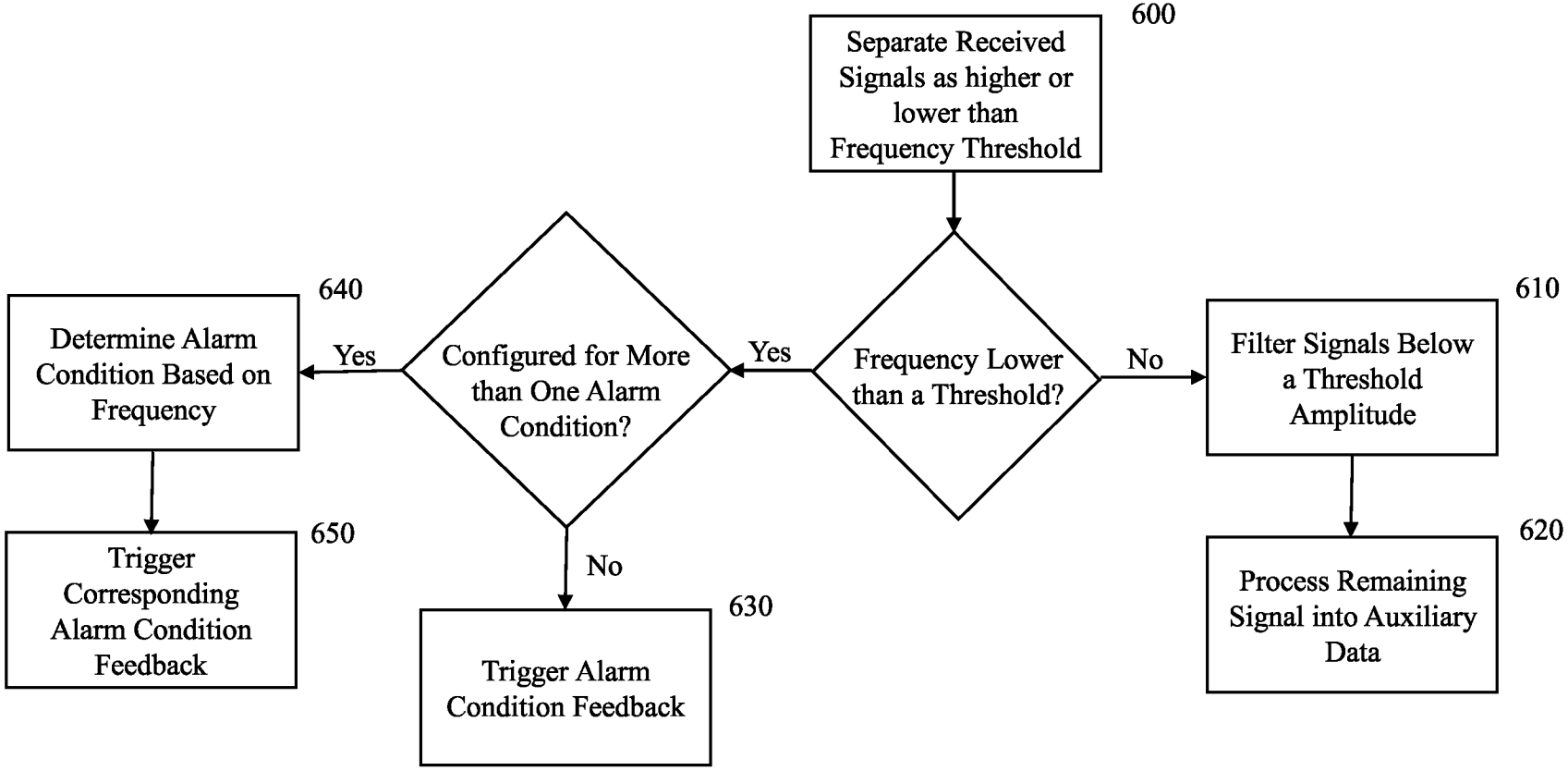
FIG. 6: A process flow diagram for receiving tandem signals.

FIG. 6 is a process flow diagram for receiving tandem signals. The process of receiving signals over a tandem line may comprise separating received signals based on a frequency threshold 600, filtering out signals having an amplitude below a threshold 610, and processing the signal into auxiliary data 620. In some embodiments, the process may also comprise triggering an alarm condition feedback 630. In some embodiments, the process may also comprise determining an alarm condition based on signal frequency 640 and triggering an alarm condition feedback corresponding to the specific alarm condition 650.

Step 600 depicts the first step of separating received signals based on a frequency threshold. In this step, signals for noise and/or auxiliary data are separated from signals for alarm conditions. The signals having a frequency lower than the frequency threshold comprise alarm condition signals. Conversely, the signals having a frequency higher than the frequency threshold comprise noise and/or auxiliary data. The frequency threshold may be greater or substantially greater than the noise frequency. The noise frequency may generally be 60 Hz.

Additionally, the frequency threshold of step 600 may comprise two separate thresholds frequency—an auxiliary threshold frequency and an alarm condition threshold frequency. Both thresholds may be greater than the noise signal frequency. The signals lower in frequency than the alarm condition threshold frequency comprise alarm condition signals. Conversely, the signals higher in frequency than the auxiliary threshold frequency comprise noise and/or auxiliary data. In some embodiments, when the auxiliary threshold frequency and the alarm condition threshold frequency are different, a dead zone of unusable frequencies may be created. In other embodiments, the auxiliary threshold frequency and the alarm condition threshold frequency are equivalent and configured as a single threshold frequency.

In step 610 the signals having a frequency higher than the frequency threshold are filtered out based on a threshold amplitude to extract auxiliary data signals. Signals having an amplitude below the threshold amplitude may be noise, and the signals having an amplitude above the threshold amplitude may be the auxiliary data signals. The threshold amplitude may be generally greater than the noise signal amplitude. Subsequently in step 620, the signals having an amplitude greater than the threshold amplitude are processed into auxiliary data.

If the process is configured only for one alarm condition, the process proceeds to step 630 for signals having frequencies lower than the frequency threshold and an alarm condition feedback is triggered. Alternatively, if the process is configured for a plurality of alarm conditions, the process proceeds to step 640.

In step 640 the alarm conditions are determined based on the signal frequency. For example, the process may assign a frequency of approximately 5 Hz as a carbon monoxide alarm condition and the frequency range of approximately 1 Hz as a smoke alarm condition.

Following the determination of the alarm condition, in step 650 an alarm condition feedback is triggered. Further, the triggered alarm condition feedback may correspond to the specific alarm condition. For example, a speaker may emit an audible alarm of one sound for a smoke alarm condition and a different sound for a carbon monoxide alarm condition.

Some embodiments of the present disclosure have the advantage of enabling auxiliary data communication over a tandem line. Traditionally, tandem lines are limited to mere alarm condition signals and filter out noise based on a frequency threshold. However, such a configuration limits the information communicated to mere alarm condition types based on large frequencies which are necessarily substantially lower than the 60 Hz noise frequency. The present disclosure enables the transmission and receipt of auxiliary data by transmitting the data in higher frequency bursts during the noise signal peaks, or by transmissions not having a period greater than the first duration. Further, by maintaining the frequency threshold for alarm conditions, the present disclosure prevents false alarm conditions from being triggered by the auxiliary data tandem signal. Accordingly, the present disclosure enables the communication of data from auxiliary devices over an alarm network tandem line without interfering with the tandem lines alarm condition communication operation.

Figure 7:
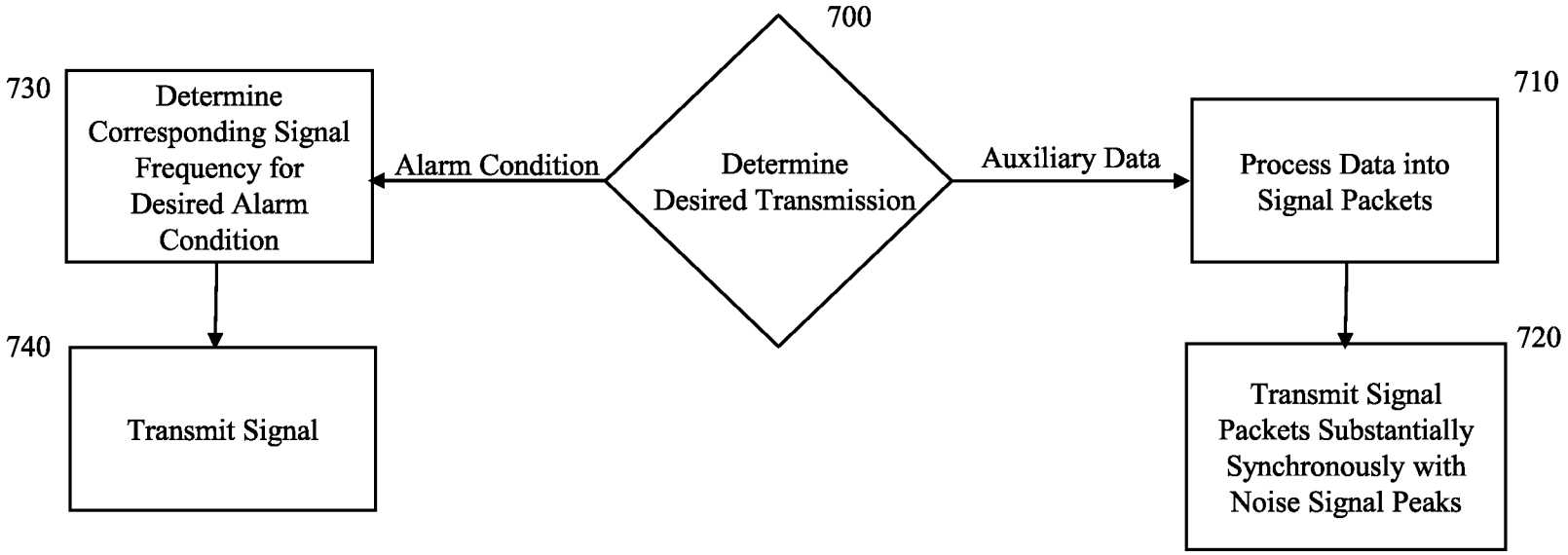
FIG. 7: A process flow diagram for transmitting tandem signals according to some embodiments of the present disclosure.

FIG. 7 is a process flow diagram for transmitting tandem signals according some embodiments of the present disclosure. The process of transmitting signals over a tandem line may comprise determining the desired transmission type 700, processing data into signal packets 710, and transmitting the signal packets 720. In some embodiments, the process may also comprise determining a signal frequency corresponding with an alarm condition 730 and transmitting the signal 740.

Step 700 depicts the first step of determining the type of transmission desired. If the desired transmission is auxiliary data, the process proceeds to steps 710 and 720. However, if the desired transmission is an alarm condition, the process proceeds to steps 730 and 740.

In step 710, auxiliary data is processed into data signal packets. The auxiliary data may be processed into a single data packet or a plurality of packets, depending on the amount of auxiliary data. These data signal packets are sized such that the auxiliary data signal is generally equal in duration to the peak of a noise signal. Additionally, the data signal packets are of an amplitude such that the combined amplitude of the data signal packet and the noise signal is greater than an amplitude threshold, the amplitude threshold being generally greater than the noise signal amplitude. Subsequently, in step 720, the signal packets are transmitted substantially synchronously with the noise signal peaks.

In step 730, the alarm signal condition is translated into a corresponding signal frequency. For example, alarm condition signals for carbon monoxide may be approximately 5 Hz and alarm condition signals for smoke may be approximately 1 Hz. Subsequently, in step 740, the alarm condition signal is transmitted over the tandem line.

Embodiments of the present disclosure have the advantage of enabling auxiliary data transmission over a tandem line. Exploiting the presence of a frequency threshold when receiving alarm condition signals and transmitting the auxiliary data in packets during noise signal peaks, avoids the triggering of false alarm conditions. Traditionally, tandem lines are limited to mere alarm condition signals and filter out noise based on frequency. Accordingly, the present disclosure enables the communication of data from auxiliary devices over an alarm network tandem line without interfering with the tandem lines alarm condition communication operation.

Figure 8:
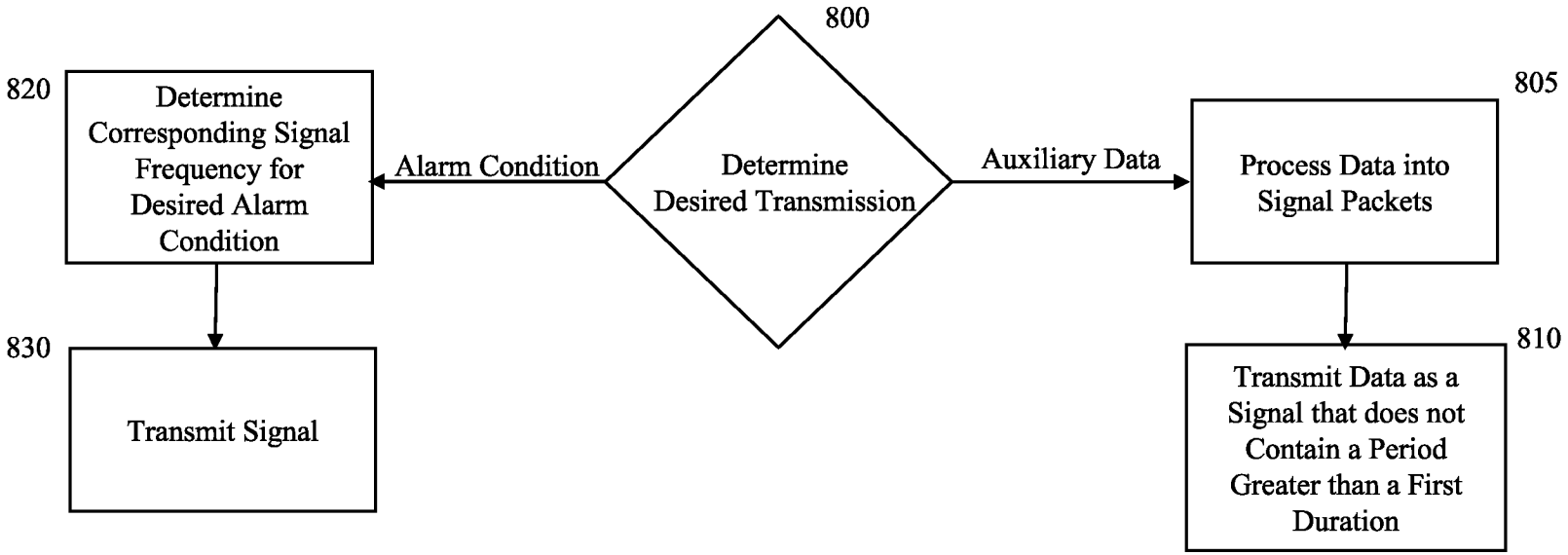
FIG. 8: A process flow diagram for transmitting tandem signals according to some embodiments of the present disclosure.

FIG. 8 is a process flow diagram for transmitting tandem signals according to some embodiments of the present disclosure. The process of transmitting signals over a tandem line may comprise determining the desired transmission type 800 and transmitting data as a signal that does not contain a period greater than a first duration 810. In some embodiments, the process may additionally comprise processing data into signal packets 800. Further, some embodiments of the process may also comprise determining a signal frequency corresponding with an alarm condition 820 and transmitting the signal 830.

Step 800 depicts the first step of determining the type of transmission desired. If the desired transmission is auxiliary data, the process proceeds to steps 805 and/or 810. However, if the desired transmission is an alarm condition, the process proceeds to steps 820 and 830.

In step 805, the auxiliary data may be processed into one or more data signal packets. These data signal packets may be sized such that the auxiliary data signal does not contain a period having a first duration. The period measured between two of: disruption points, auxiliary data transmission beginning, auxiliary data packet beginning, auxiliary data transmission finish, and auxiliary data packet finish, the two being adjacently disposed. The combined amplitude of the noise signal and the data signal is less than an amplitude threshold during the transmission of a disruption point. Accordingly, a disruption point may be a zero between noise signal peaks. The first duration is equal to one period of a frequency equal to the frequency threshold. The data signal packets are of an amplitude such that the combined amplitude of the data signal packet and the noise signal is greater than an amplitude threshold, the amplitude threshold being generally greater than the noise signal amplitude. Subsequently, in step 810, the one or more signal packets are transmitted with periods no greater than the first duration.

In step 820, the alarm signal condition is translated into a corresponding signal frequency. For example, alarm condition signals for carbon monoxide may be approximately 5 Hz and alarm condition signals for smoke may be approximately 1 Hz. Subsequently, in step 830, the alarm condition signal is transmitted over the tandem line.

Embodiments of the present disclosure have the advantage of enabling auxiliary data transmission over a tandem line. Exploiting the presence of a frequency threshold, when receiving alarm condition signals and transmitting the auxiliary data in packets during noise signal peaks, avoids the triggering of false alarm conditions. Traditionally, tandem lines are limited to mere alarm condition signals and filter noise based on frequency. Accordingly, the present disclosure enables the communication of data from auxiliary devices over an alarm network tandem line without interfering with the tandem lines alarm condition communication operation.

FIGS. 9 *a-d* illustrate the various signals transmitted via a tandem line in accordance with some embodiments of the present invention. FIG. 9*a*, is a schematic graph showing a noise signal 900 in the form of voltage as a function of time. Further, FIG. 9*b* is a schematic graph showing an alarm condition tandem signal 910 and noise signal peaks 30. The frequency of the alarm condition tandem signal 910 is substantially lower than the noise frequency, which may be generally 60 Hz. Accordingly, the frequency discrepancy between the two signals illustrates how alarm condition signals are isolated from noise signals.

Figure 9A:
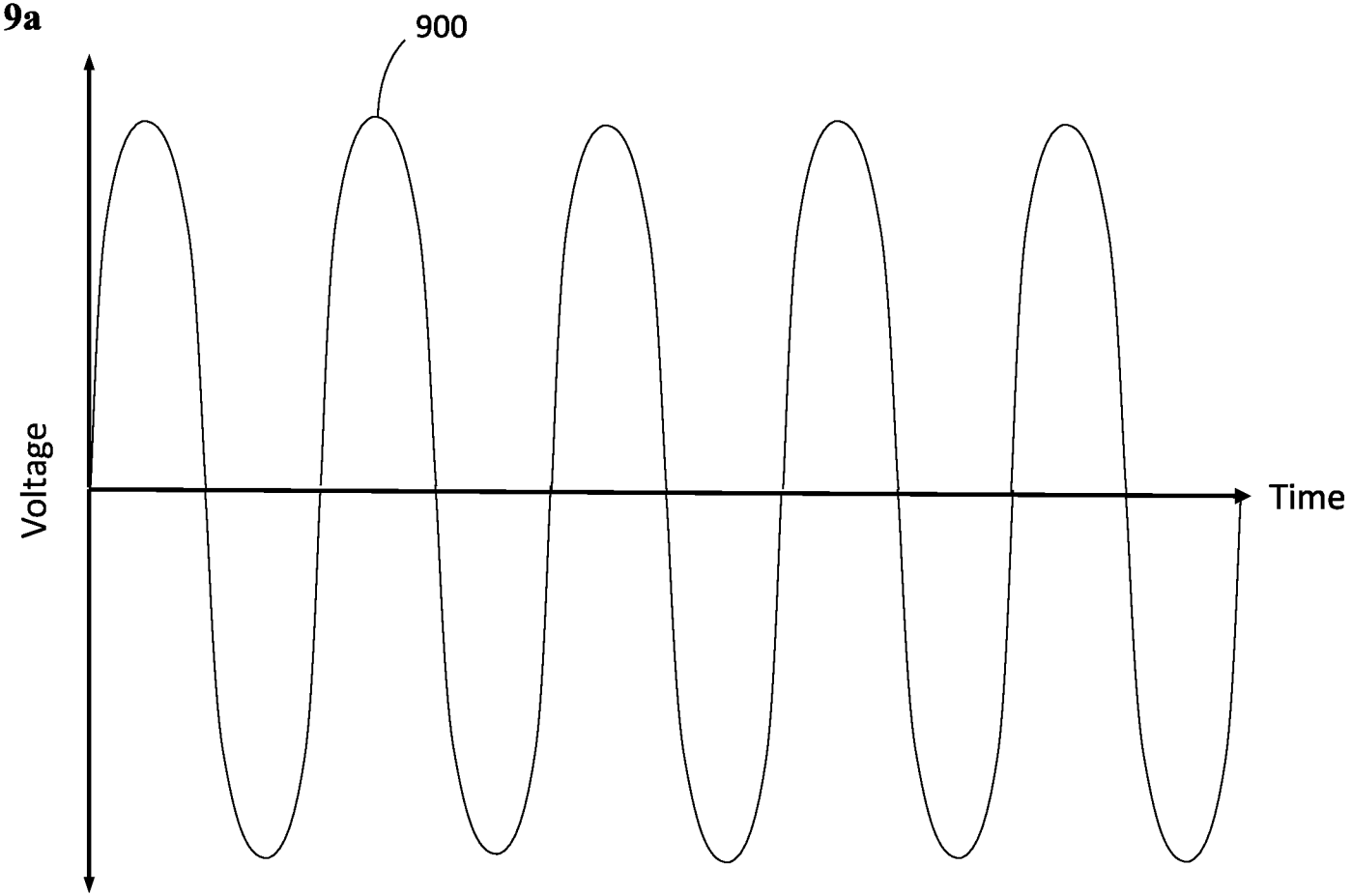
FIG. 9*a*: A schematic graph of a noise signal plotted as voltage as a function of time.
Figure 9B:
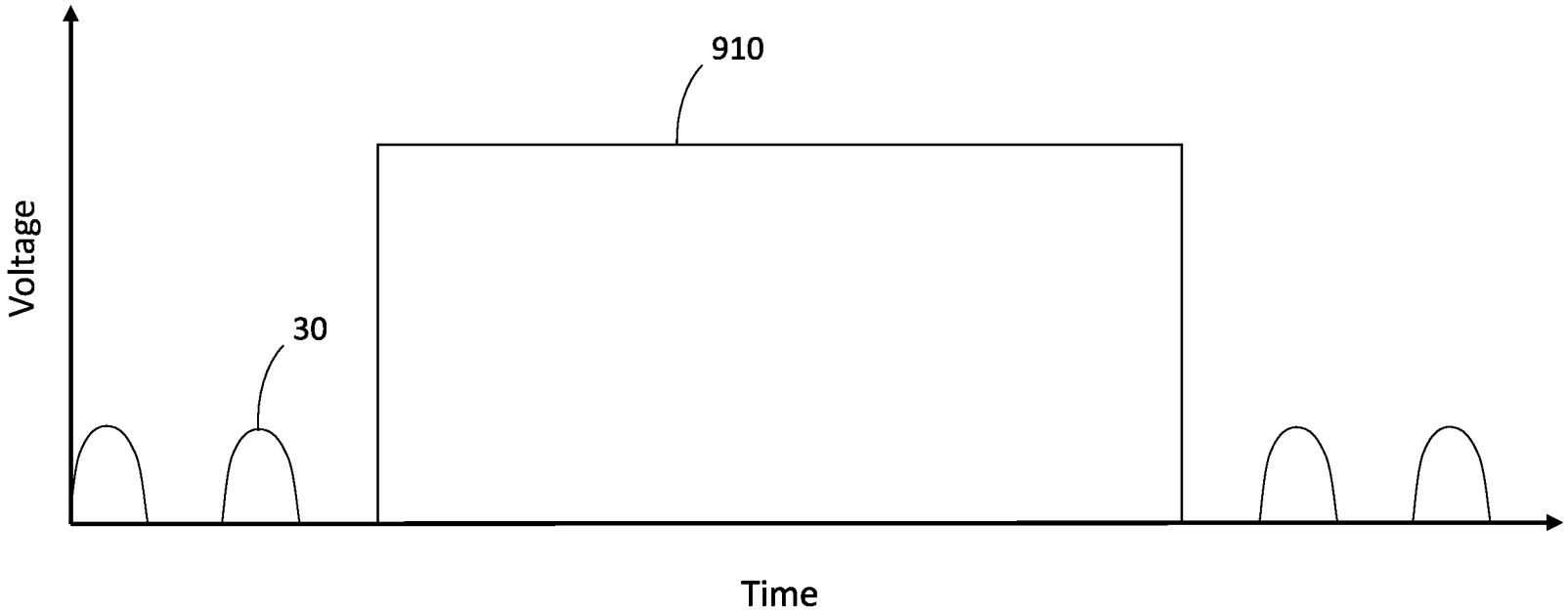
FIG. 9*b*: A schematic graph of an alarm condition tandem signal plotted as voltage as a function of time.
Figure 9C:
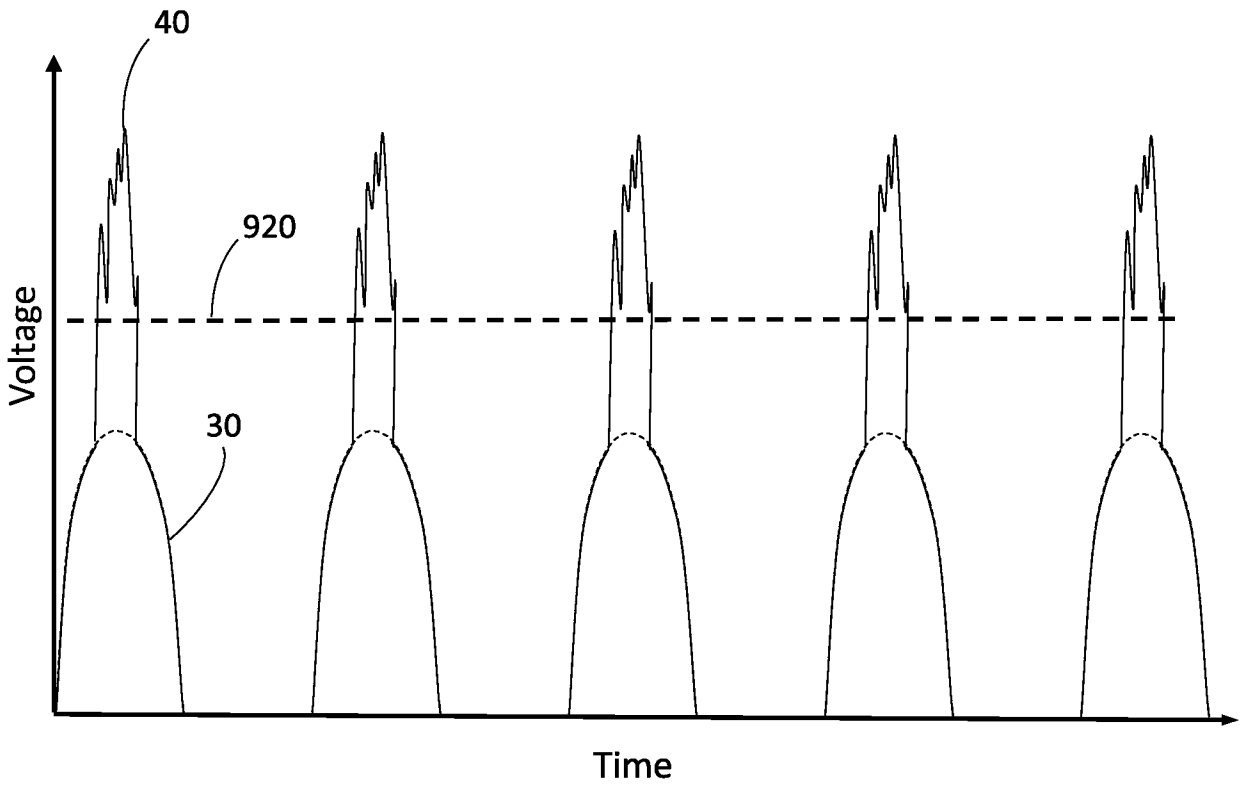
FIG. 9*c*: A schematic graph of synchronous transmission plotted as voltage as a function of time.

FIG. 9*c* is a schematic graph illustrating an embodiment of transmitting auxiliary data substantially synchronous with noise signal peaks. As shown, the auxiliary data is transmitted as a series of auxiliary data packets 40. An auxiliary data packet 40 may be transmitted such that it substantially synchronous with noise signal peak 30. Further, the dotted line 920 illustrates an amplitude threshold. At the amplitude threshold, noise signals are filtered by an auxiliary controller. Accordingly, FIG. 9*c* illustrates an embodiment of relative amplitudes of the synchronous transmissions, the noise signal peaks, and the amplitude threshold.

Figure 9D:
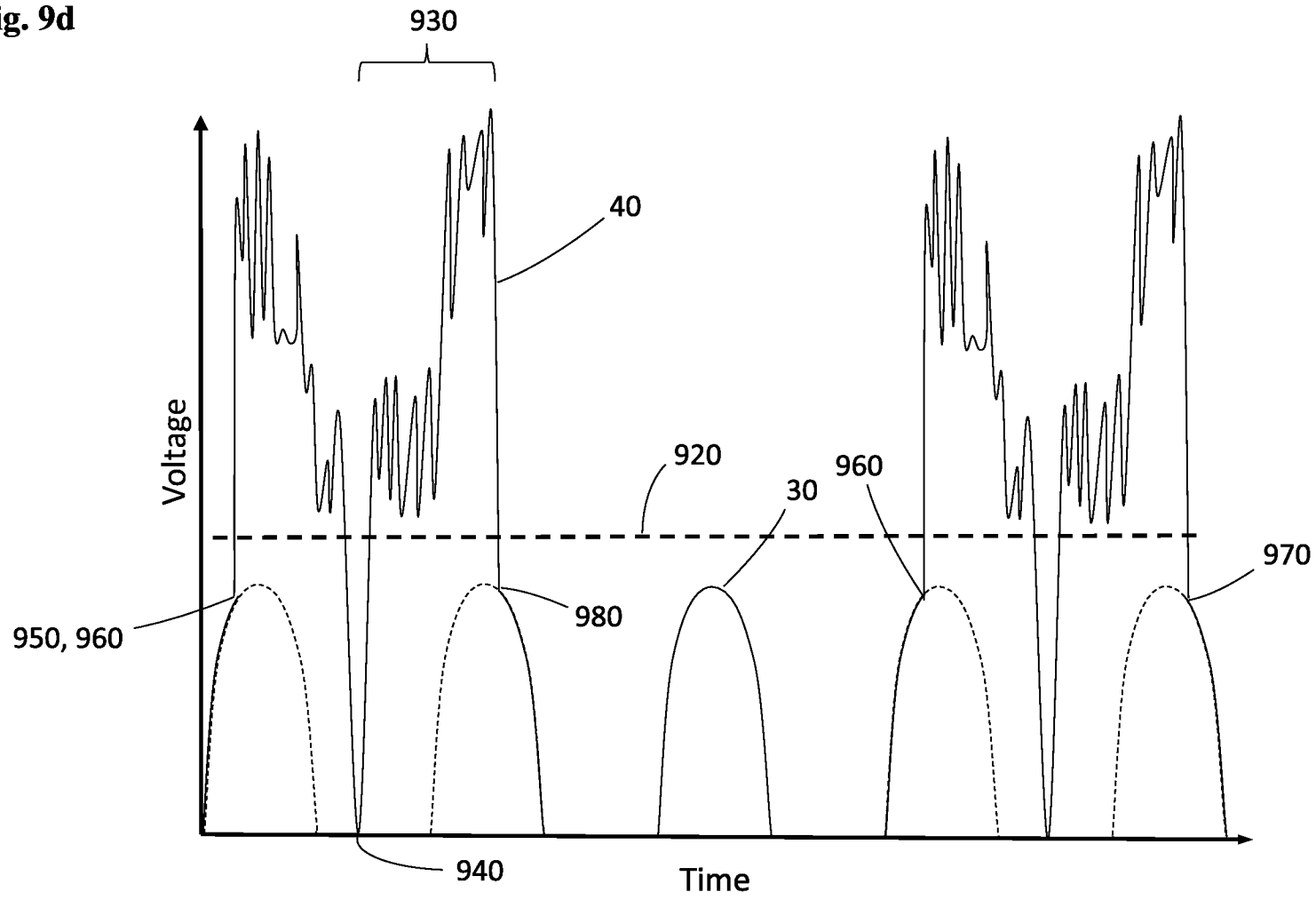
FIG. 9*d*: A schematic graph of transmitting auxiliary data having a period less than a first duration.

FIG. 9*d* is a schematic graph illustrating an embodiment of transmitting auxiliary data having a period less than a first duration. As shown, the auxiliary data is transmitted as a series of auxiliary data packets 40. An auxiliary data packet 40 may be transmitted such that the transmission does not contain a period 930 having a first duration. The period is measured between two of: disruption points 940, auxiliary data transmission beginning 950, auxiliary data packet beginning 960, auxiliary data transmission finish 970, and auxiliary data packet finish 980, the two being adjacently disposed. The combined amplitude of the noise signal and the data signal is less than an amplitude threshold 920 during the transmission of a disruption point 940. Accordingly, a disruption point 940 may be a zero between noise signal peaks. Further, the first duration may be equal to one period of a frequency equal to the frequency threshold.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

In this document, relational terms, such as "first," "second," "third," and the like, are used solely to distinguish one entity or action from another entity or action, without necessarily requiring or implying any actual such relationship or order between such entities or actions.

As used herein, the term "and/or," when used in a list of two or more items, means that any one of the listed items can be employed by itself, or any combination of the two or more of the listed items can be employed. For example, if a composition is described as containing components A, B, and/or C, the composition can contain A alone; B alone; C alone; A and B in combination; A and C in combination; A and C in combination; B and C in combination; or A, B, and C in combination.

The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

It is to be understood that although several embodiments are described in the present disclosure, numerous variations, alterations, transformations, and modifications may be understood by one skilled in the art, and the present disclosure is intended to encompass these variations, alterations, transformations, and modifications as within the scope of the appended claims, unless their language expressly states otherwise.

What is claimed is:

1. A device comprising:

a detector device configured to detect an alarm condition, the alarm condition comprising the presence of at least one of smoke, carbon monoxide, flames, gas particles, or chemicals;

a detector controller communicatively connected to the detector device, the detector controller operable to:

communicatively connect to a tandem line, and at least one of transmit and receive a first tandem signal from the tandem line, to or from a second device, the first tandem signal:

corresponding to an alarm condition, and having a frequency lower than a first frequency threshold, the first frequency threshold lower than a noise signal frequency, the noise signal present on the tandem line; and an auxiliary controller operable to:

communicatively connect to the tandem line, and at least one of transmit and receive a second tandem signal from the tandem line, wherein:

the second tandem signal transmitted or received is substantially synchronous with a noise signal peak, the combined amplitude of the tandem signal and the noise signal is greater than a first amplitude threshold, and the noise signal peak has an amplitude generally less than the first amplitude threshold.

2. The device of claim 1, further comprising:

an auxiliary device communicatively connected to the auxiliary controller, the auxiliary device operable to at least one of transmit and receive auxiliary data signals respective the auxiliary controller;

wherein the second tandem signal is based, at least in part, on the auxiliary data.

3. The device of claim 1, wherein the auxiliary controller is further operable to filter out signals having an amplitude generally less than the first amplitude threshold.

4. The device of claim 1, wherein the auxiliary controller is further operable to filter out signals having a frequency lower than a second frequency threshold, the second frequency threshold lower than the noise signal frequency.

5. The device of claim 4, wherein the first frequency threshold and the second frequency threshold are the same.

6. The device of claim 4, wherein the detector controller is further operable to at least one of:

receive an alarm condition signal from the detector device and upon receipt of the alarm condition signal, transmit the first tandem signal; and filter out signals having a frequency higher than the first threshold frequency and upon receipt of the first tandem signal, trigger an alarm condition feedback.

7. The device of claim 6, wherein the alarm condition feedback is the emission of an audible sound by a speaker.

8. The device of claim 1, further comprising:

an auxiliary port configured to receive a wired connection from an auxiliary device, whereby the auxiliary port is operable to at least one of transmit and receive auxiliary device data, the auxiliary port communicatively connected to the auxiliary controller;

wherein the transmitted second tandem signal is based, at least in part, on the auxiliary device data.

9. The device of claim 1, wherein the detector controller and the auxiliary controller are sub-controllers of a single controller.

10. A device network comprising:

a plurality of alarm devices communicatively connected via a network of one or more tandem lines, each alarm device operable to:

detect an alarm condition, and at least one of transmit and receive a first tandem signal from the tandem line network, to or from a second alarm device, the first tandem signal:

corresponding to an alarm condition, and having a frequency lower than a first frequency threshold, the first frequency threshold lower than a noise signal frequency, the noise signal present on the tandem line network; and one or more auxiliary devices communicatively connected to the tandem line network, each auxiliary device operable to at least one of transmit and receive a second tandem signal over the tandem line network, wherein:

the second tandem signal transmitted or received is substantially synchronous with a noise signal peak, the combined amplitude of the tandem signal and the noise signal is greater than a first amplitude threshold, and the noise signal peak has an amplitude generally less than the first amplitude threshold.

11. The device network of claim 10, wherein the auxiliary device is further operable to filter out signals having a frequency generally less than a second frequency threshold, the second frequency threshold lower than the noise signal frequency.

12. The device network of claim 10, wherein the alarm condition comprises the presence of at least one of smoke, carbon monoxide, and flames.

13. The device network of claim 11, wherein the first frequency threshold is equal the second frequency threshold.

14. The device network of claim 10, wherein each of the alarm devices are operable to:

trigger an alarm condition feedback, upon detection of the alarm condition;

transmit the first tandem signal, upon detection of the alarm condition; and trigger the alarm condition feedback, upon receipt of the first tandem signal.

15. The device network of claim 10, wherein at least one auxiliary device is disposed within at least one of the alarm devices.

16. The device network of claim 10, wherein:

at least one of the alarm devices comprises an auxiliary port, and at least on auxiliary device is communicatively connected to the alarm device via the auxiliary port.

17. A method for communicating over a network comprising:

filtering out signals having an amplitude below a first threshold amplitude, the first threshold amplitude generally greater than a noise signal amplitude, the noise signal present on the network;

at least one of transmitting and receiving a first signal over a network, the first signal:

corresponding to an alarm condition, and having a frequency lower than a first frequency threshold, the first frequency threshold being a frequency lower than the noise signal frequency; and at least one of transmitting and receiving a second signal over the tandem line network, wherein:

the second tandem signal transmitted or received is substantially synchronous with a noise signal peak, the combined amplitude of the tandem signal and the noise signal is greater than a first amplitude threshold, and the noise signal peak has an amplitude generally less than the first amplitude threshold.

18. The method for communication over a network of claim 17, further comprising differentiating between received first signals and received second signals based, at least in part, on frequency.

19. The method for communicating over a network of claim 17, wherein:

the network is a fire alarm tandem line network, and the alarm condition corresponds to the presence of at least one of a smoke particle and a gas particle.

20. The method for communicating over a network of claim 17, further comprising triggering an alarm condition feedback, upon receipt of the first signal.

* * * * *